United States Patent [19]

Lazcano-Navarro et al.

[11] Patent Number: 4,799,651

[45] Date of Patent: Jan. 24, 1989

[54] DEVICE FOR INTRODUCING SEPARATED FLUIDS THROUGH INDEPENDENT FLOW PATHS THROUGH BOTTOM TUYERES IN A ROTATING METALLURGICAL CONVERTER

[76] Inventors: Arturo Lazcano-Navarro; Miguel A. Alcantara; Jose E. Hernandez-Ruiz, all of Saltillo, Coahuila, Mexico

[21] Appl. No.: 813,566

[22] Filed: Dec. 26, 1985

[51] Int. Cl.[4] ..... C21C 5/48; C21C 5/50

[52] U.S. Cl. ..... 166/268; 266/245

[58] Field of Search ..... 266/222, 245, 246, 247, 266/267, 268

[56] References Cited

U.S. PATENT DOCUMENTS

| | | | |
|---|---|---|---|
| 3,893,658 | 7/1975 | Fisher | 266/222 |
| 4,055,335 | 10/1977 | Fisher | 266/245 |
| 4,284,266 | 8/1981 | Nagati | 266/246 |
| 4,325,540 | 4/1982 | Seki et al. | 266/245 |
| 4,387,884 | 6/1983 | Seki et al. | 266/246 |
| 4,428,564 | 1/1984 | Nagati | 266/246 |
| 4,606,531 | 8/1986 | Lazcano-Navarro et al. | 266/245 |

FOREIGN PATENT DOCUMENTS

| | | | |
|---|---|---|---|
| 2703955 | 8/1978 | Fed. Rep. of Germany | 266/246 |

*Primary Examiner*—L. Dewayne Rutledge
*Assistant Examiner*—Robert L. McDowell

[57] ABSTRACT

A mechanism and flow conduits for introducing and transporting a set of separated fluids and a stream of solid fines through passageway in a rotating metallurgical converter for introducing such fluids and solid fines into a liquid metal contained in the converter.

Stationary conduits from flow sources connect to a non rotative sleeve which forms the external portion of a rotary joint able to introduce a set of separated fluids into the rotating converter passageways. Each separated stationary fluid conduit connects to port holes in the fixed sleeve to lead the flow to the interior of the sleeve, and connects a circumferential channel formed in rotating rings located between a rotating shaft affixed to the converter vessel trunnion pin and the static sleeve with a seal between each adjacent ring and corresponding channel. A port hole is located in each rotating channel ring for leading the fluid through internal flow paths inside and along the axis of the shaft body.

The flows paths connect to a plurality of pipes contained inside the trunnion pin central bore, which, in turn, connect a set of port holes of a multi passageway elbow, which serves for leading the fluids and solid fines stream to the ring side end of the trunnion pin and changes the direction of the fluids and stream of solids by ninety degrees so as to direct such fluids to the botton pipe lines which finally end up in the converter bottom injection nozzles.

5 Claims, 12 Drawing Sheets

DEVICE FOR INTRODUCING SEPARATED FLUIDS THROUGH INDEPENDENT FLOW PATHS THROUGH BOTTOM TUYERES IN A ROTATING METALLURGICAL CONVERTER

BACKGROUND OF THE INVENTION

In the present state of the art of steelmaking or treating liquid ferrous metals in a converter of the type used in the basic oxygen steelmaking process, there is a clear tendency towards the injection of various gases and powders into the liquid metal through the bottom of such converter by means of a properly designed mechanism and tuyeres for injection. For instance, in some processes for oxygen steelmaking in a bottom blown converter, a plurality of gases and powder must be injected through tuyeres located in the converter bottom. This implies the simultaneous and continuous introduction and transport through the converter passageways of such fluids and solid fines streams in order to accomplish their continuous injection into the liquid metal contained in the converter, even during rotation.

In this type of process, a typical set of flowpaths consists of a line for leading various gases or gas/solid mixtures according to the stage of the process, i.e., oxygen or oxygen/lime mixture, or argon, or nitrogen, or air from such line. The fluids are distributed and finally led to set of bottom converter tuyeres for injection into the liquid bath. In the same typical flow path, a number of lines are used for transporting cooling gases to be injected in the liquid bath through outer annular tuyeres formed by a second pipe evolving from the central nozzle, which as mentioned serves for injection of process gases, i.e. oxygen or oxygen/lime mixture, inert gases, etc.

In this arrangement of double outlets, the annular nozzle injects a cooling gas, preferable hydrocarbon, when the central nozzle is injecting oxygen, so as to protect the whole tuyere from a high temperature rise. In this case it is convenient to have independent flow paths for individual control. This is because in the annular outlet the formation of accretions or metallic deposits is likely to occur, and this results in obstructions of the fluid flow in a given particular line, and hence the necessity of controlling this particular line with no change in the rest of the separated flow paths; for instance, each separated line provided with a flow control valve and check valve; this last one to avoid counter flow of oxygen from the central nozzle when the control pressure exceeds the annular gas pressure and a channeling from center to annular occurs due to metallic deposit in the annular nozzle.

Within the group of technologies for treating molten ferrous metal for producing high quality steel, the ones referred to with combined blowing with bottom injection of gases for agitation of the liquid metallic bath have shown many metallurgical improvements with advantages in cost and operation.

Again in this case, it is convenient to have separated flowpaths for independent control if an optimum performance regarding the injection volumes and specific power of agitation is expected.

A design generation known in the present art of the technology for introducing several fluids into a rotating metallurgical converter is disclosed in U.S. Pat. No. 3,893,658; US. Pat. No. 4,284,266 and U.S. Pat. No. 4,325,540. These rotary joints are based on the principle of concentric tubes for independent flow of fluids through each annular gap formed between tubes when passing from a stationary to a rotating system. The practical inconvenience of these rotary joint designs is that every extra fluid to be introduced requires a corresponding extra tube to form another annular space for fluid transport, and this results in a signifcant increment of size, both in diameter and length of the apparatus. In this regard, an aspect related to the fluid dynamics of the system is the fact that, when the fluids flow into the space formed by concentric tubes in the above mentioned arrangement, the cross section of the conduit is not of a circular geometry; this may result in disturbance of the dynamics of the system like drop of pressure and poor response during control, as when introducing and transporting controlled fluids in a rotating converter, It is desirable to have conduits of circular cross section along the total flow paths up to the point of the injection tuyere outlet.

A stringent condition of transport is the case of pneumatically conveyed powder through a metallurgical converter flow path for injection for instance lime, or carbon bearing powders. These are injected for metallurgical and heat balance control reasons, respectively, and their pneumatic handling imply difficulties in transport and deterioration of hardware due to the abrasive properties of the powdered material; this in turn implies the necessity of adequately designed flow paths. If the introduction and transport of a powder stream into a metallurgical rotating converter follows a flow path configuration similar to a conventionally designed one for pneumatic transport, the performance of the system is better than in the case of a complicated or non-conventional design, for instance in the rotary joint device for introducing the powder/gas mixture from the static to the rotating system. A device known in the art for introducing fluids and a stream of solids into a tiltable metallurgical converter is disclosed in U.S. Pat. No. 4,055,335, in which design the stream of solids pneumaticaly conveyed enters a rotary joint through a lateral opening and flows through an annular space within such rotary joint. In this case, the stream of solids do not follow a typical path used in pneumatic transport of solid fines, and the design for manufacture is not as simple as desired. This Patent also discloses a system for transporting fluids and a stream of solid fines along converter fluid paths, particularly a plurality of concentric passageways in the trunnion shaft central bore radial flow paths from such concentric pipes are also used, with the associated complexity of manufacture and secondary effects on the performance of the solid fines transport.

The present invention is related to a rotary joint mechanism for introducing separated fluids and solid fines, and then a plurality of flow path arrangement in a tiltable metallurgical converter with special design characteristics with improved performance regarding fluid flow and solid transport in the converter passageways, and with a very simple design and construction.

SUMMARY OF THE INVENTION

The apparatus and flow path designs presented in this invention are conceived for the introduction and transport of a plurality of separated fluids and a stream of solid fines, at least through one of two trunnion pins of a rotating metallurgical converter for the bottom injection of such fluids and solid fines into the liquid metal.

The invention includes the following: a specially designed rotary joint of multifluid passageways for introducing fluids and a stream of solid fines from a stationary set of conduits into a rotating trunnion pin of a metallurgical converter. From a rotating rotary joint shaft, a plurality of pipes connect to a multi-flow path elbow which serves to lead such fluids to a set of pipes oriented perpendicular to the shaft axis direction and used to lead the fluids and solid fines to the bottom mechanism and tuyeres for injection.

The first part of the whole arrangement consists of a rotary joint with particular characteristics, like the ability to handle a relatively high number of separated fluids for individual control; a constant cross sectional area along the passageways, both in surface area and geometry; a sealing efficiency proportional to the pressure of the flowing fluid; a very simple design concept with direct benefits in fabrication, mantenance and operation. Associated to the rotary joint apparatus, a plurality of stationary or fixed pipes, which transport a corresponding plurality of fluids from their source, connect the rotary joint entry ports which open perpendicular to direction of the axes of a cylindrical static sleeve which forms the external component of the rotary joint apparatus. This external cylindrical sleeve is anchored to an external fixed point. Each separated fluid, usually gas, flows through the sleeve port into a circumferential conduit mainly formed by a channeled ring mounted and fixed to a central rotating shaft that, in turn, is affixed to the rotating converter trunnion pin. The outer diameter wall of the circumferential conduit is formed by a segment of the inner side of the static sleeve and the sealing means, which between each channel are formed by the contact of a cup type seal ring and the metallic sleeve segment. So, when the converter is rotating the components of each circumferential conduit rotate except the outer wall formed by the static sleeve segment, i.e., the channel ring fixed to the central rotating shaft, and the cup type seal ring, both of which rotate together with the central shaft and the rest of the converter components.

Each channel ring has an open port that leads the fluid to a corresponding passageway formed in the interior of the central rotary shaft and parallel to the axis of the shaft; the number of channeled rings or circumferential conduits is the same as the number of rotary shaft passageways. Such a passageway arrangement in rotation forms a revolving pipe cluster of a revolver cylinder-type distribution.

In relation to the introduction of the pneumatically transported solid fines, a stationary or externally fixed pipe enters through the central bore of the rotating shaft and connects a rotating pipe integral with the central bore rotary shaft and hence to the whole converter rotating system, with sealing means between the rotating central shaft bore and the stationary fines conduit pipe. The inside configuration corresponds to a typical pneumatic transport line, and keeps the consistency between the geometry of the transport system and the flow parameters, i.e., the geometry and size of the fixed and rotating conduit are the same as for the external stationary pipe transporting the solid from its source.

The gas flow paths in the central rotary shaft, i.e., the gas passageways parallel to the shaft axis, connect a corresponding set of pipes, preferably flexible for easy assembly and contained in the central bore of the trunnion pin, that lead the fluids to a corresponding set of entry ports in a multi-passageway radially directed elbow; such device consists of a cylindrical metallic block also contained in the central bore of the trunnion pin with a common axis.

The cylindrical block has a plurality of internal conduits bored initially parallel to its axis to form the gap passageways. Such gas passageways change to a radial direction within and with respect to the cylinder shaped block, i.e., a ninety degree deflection with respect to the axis of the elbow, and in continuing, said passageways connect to exit ports located in a curved portion of the cylindrical elbow; the exit ports are threaded for connecting straight pipes in a radial direction with respect to the pin and elbow cylinder axis. In general, these pipes are directed to the tuyere connections in the converter bottom. Thus, the multi-flow path elbow is embodied in the trunnion pin central bore and located in the converter ring side. In order to permit the passage of the pipes from elbow to the converter bottom, the trunnion pin has a lateral opening through which the pipes run towards the converter bottom for transporting a corresponding number of individual fluids from the elbow to the bottom tuyeres.

With regard to the flow path for pneumatic transport of powder from the rotary joint to the converter bottom tuyeres, it is similar to the flow path described above for gas transport, except that the multi-flow path elbow has a design detail at the ninety degree deflection point of the powders flow path. It is well known in the art for transporting solid fines that a problem of abrasion exists in a pneumatic transport line when a change of flow direction takes place, particularly a ninety degree deflection. So it is a common practice that the segment of straight pipe before the deflection is continued by a few centimeters in the same direction ahead of the flow deflection. This is useful because from the first moment of solid transport, the space created ahead of the deflection is filled with the transporting powder and so powder never hits the conduits metal wall to change its flow direction. Due to the elbow design, this principle can be applied in our case for the ninety degree deflection of solid fines flow through the central flow path of the multi-passageway elbow. Experience and studies of various types have shown that the use of this principle to avoid abrasion in pipe direction changes, does not create a pressure drop greater than any other deflection arrangement. Thus, in his invention the internal configuration of the pneumatic transport line meets the requirements for transport of any external, stationary, well-designed line.

In this invention the mechanism and flow path arrangement presented have been applied in an 8 Ton pilot installation and can be applied in a conversion of a metallurgical converter from the top blown BOF process to bottom blown type processes by preparing an adequate central bore in the trunnion shaft, if it is not already present.

DESCRIPTION OF THE PREFERRED EMBODIMENTS

Figure 1:
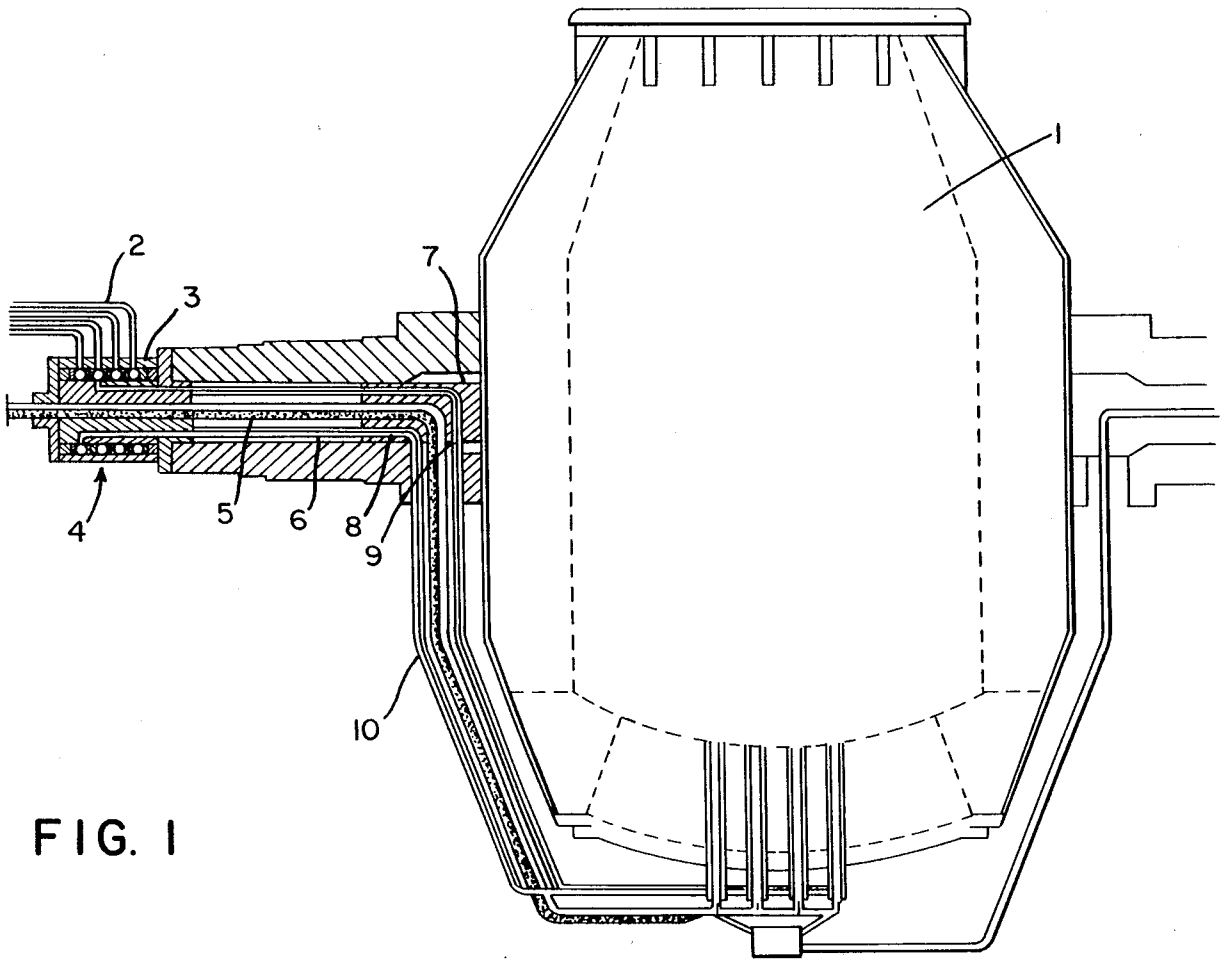
FIG. 1 shows a metallurgical converter of the type used in the basic oxygen steelmaking process and the general arrangement and positions of devices and flow paths in accordance with this invention.

FIG. 1 shows a diagrammatic representation of a converter 1 of the oxygen steelmaking process type with facilities for bottom injection of fluids and solid fines, and the location of the components and flow paths for the introduction and transport of said fluids and solids which constitute the subject matter of this invention.

Figure 2:
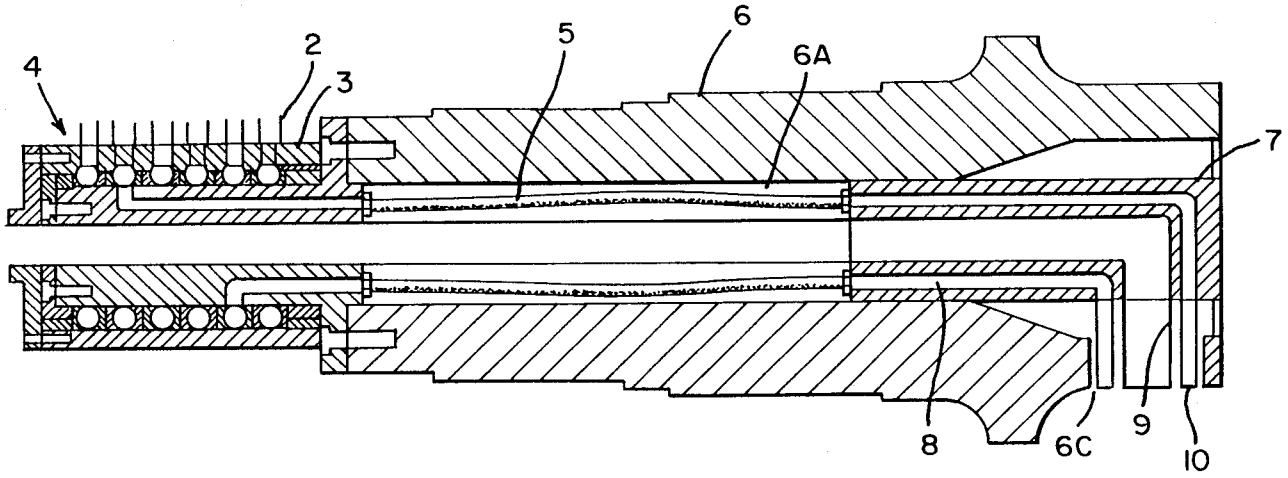
FIGS. 2 and 2A show cross-sectional elevation views of the converter trunnion pin and the corresponding main items in accordance with this invention.

FIG. 2 shows a plurality of stationary pipes 2 connected to an external stationary or static sleeve 3 which is the external component of a rotary joint 4, which mechanisms as a whole are used for introducing the fluids and stream of solids from an external static piping system 2 into the rotating converter system 1.

From said rotary joint 4, the fluids flow through a plurality of pipes 5 embodied in the central bore 6A of converter trunnion pin 6 and connected to a multi-passageway elbow 7, which in turn leads the fluids to the inner end of the trunnion pin through passageways 8 and deflects the flow lines by ninety degrees to end up in elbow radial exit ports 9; straight pipes 10 connect the elbow radial passageway threaded hole ports 9 to the converter bottom tuyeres 11, as shown in FIG. 1.

Figure 3:
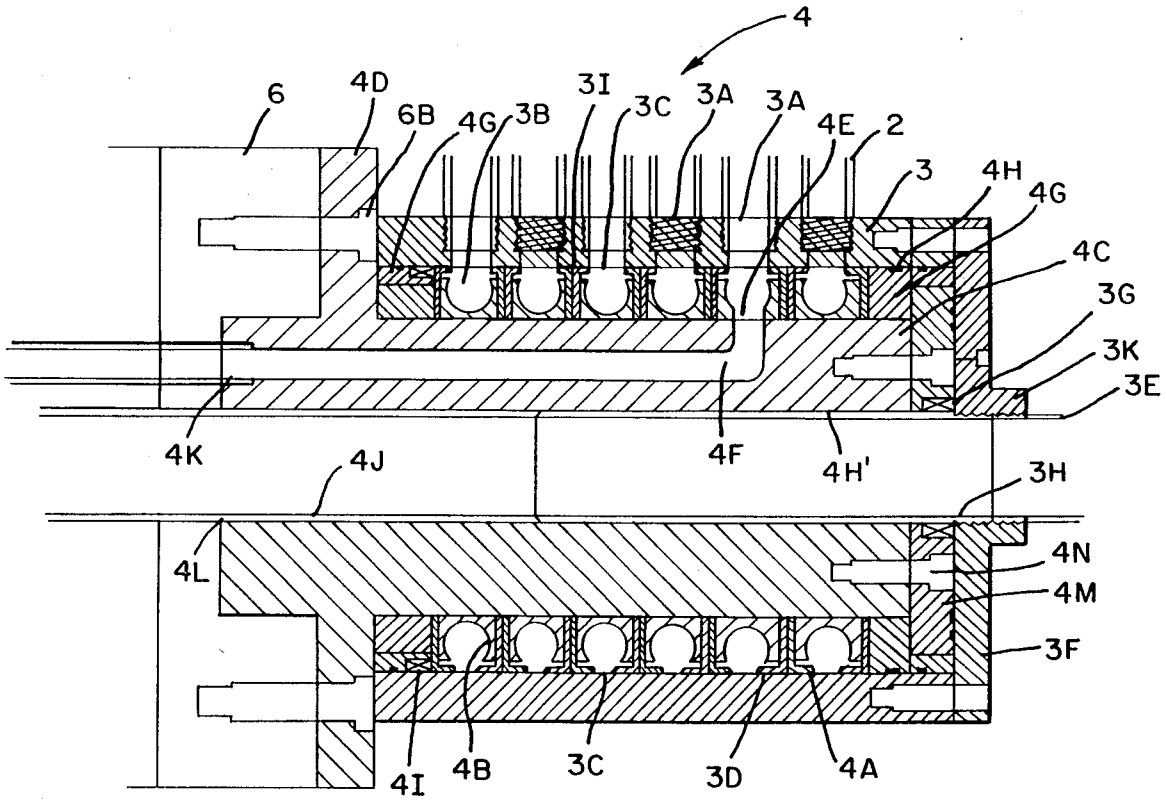
FIGS. 3 and 3A show longitudinal and transverse sectional views, respectively, of the rotary joint apparatus and the continued piping for connecting to the multi-flow path directional elbow for two different embodiments.
Figure 3A:
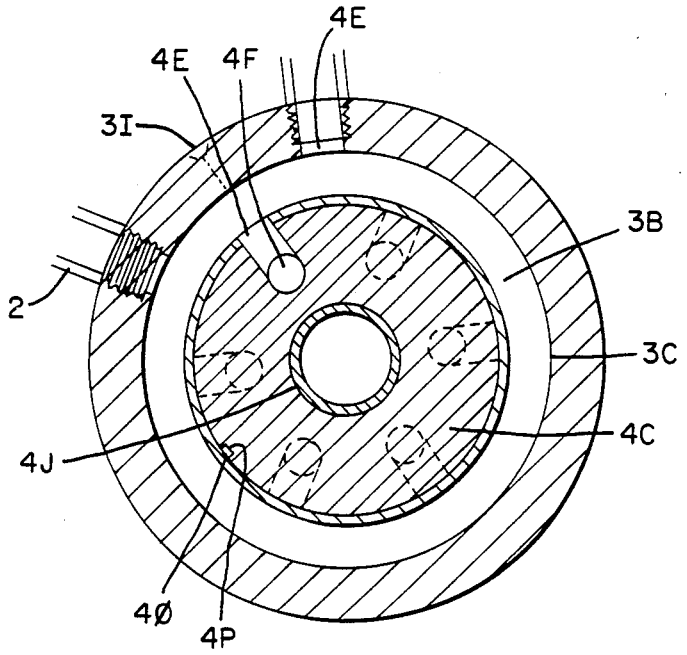
Figure 4:
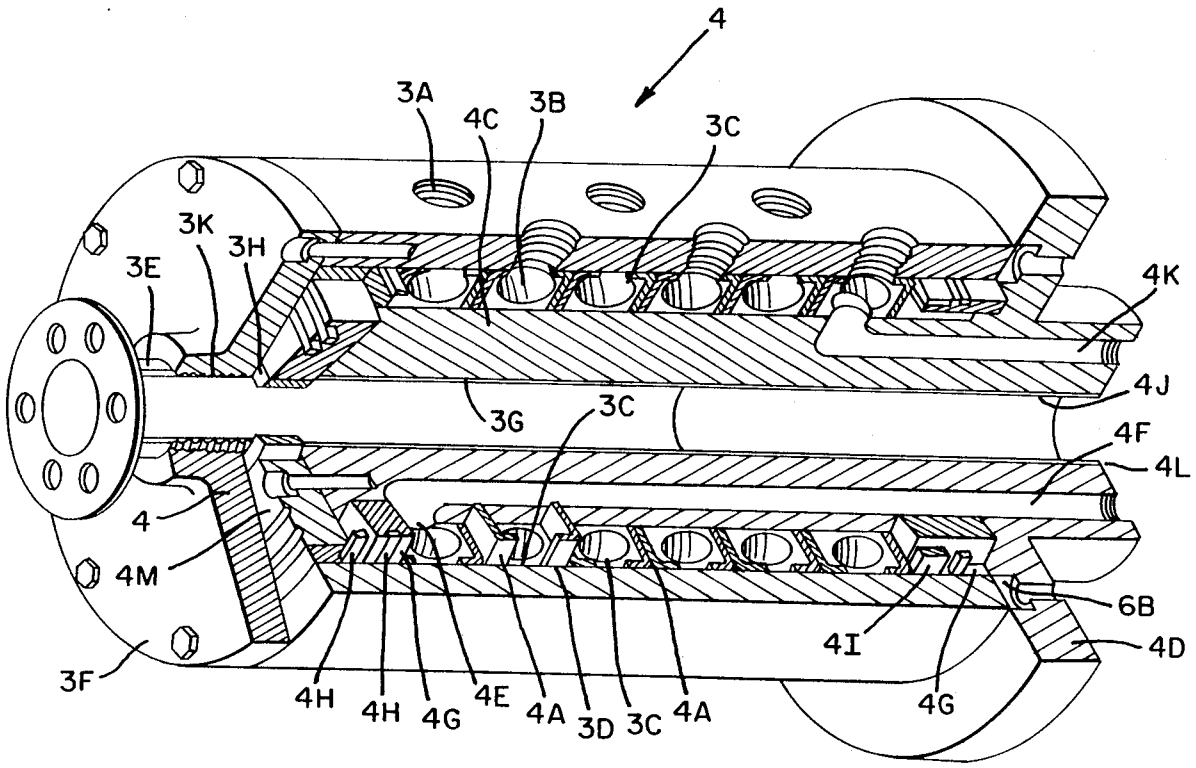
FIGS. 4, 4A, and 4B show various fragmented segments broken away in the rotary joint apparatus and an elevational longitudinal view of the rotary joint with different dimensioning for another embodiment.

According to FIG. 3 and FIG. 4 static sleeve ports 3A permit the flow of fluids to the circumferential chamber or conduit 3B. The outer portion of the circumferential conduit 3B corresponds to the inner segment 3C of sleeve 3, and inner segment of cup seal 4A which serve as sealing means between each adjacent circumferential conduit 3B, by a tight contact of common surfaces 3D between rotating cup packing seal 4A and interior static sleeve segment 3C. The rest of the circumferential conduit of chamber 3B is formed by a channeled ring 4B fixed to the rotary joint central rotating shaft 4C and flange 4D is in turn affixed to the rotating trunnion pin 6 by screws 6B. Channeled rings 4B are fixed to the central shaft 4C by means of a ring inner wedge 40 entering in the interior of a line groove 4P made along the shaft 4C (FIG. 3A).

Thus in tilting the converter, the rotating parts of circumferential chamber or conduit 3B are the channeled ring 4B and the cup seals 4A; the inner segment 3C of the sleeve 3 is stationary. The outer surface of seal 4A slides against inner surface of sleeve 3 to form a tight seal in a way that as the internal fluid pressure increases, the sealing force increases.

The rotating channeled ring 4B has radial port holes 4E to give access to shaft passageways 4F. These passageways 4F form a set or cluster of revolving conduits through which individual fluids, mainly gases, are able to flow individually controlled to any part of the rotating converter, as in that stage each independent flow path is already within the rotating system.

The support for rotation of sleeve 3 respect to shaft 4C is accomplished by metallic bearings or bushes 4G with sealing means 4H. The whole set of channeled rings 4B and corresponding couples of sealing packing cups 4A are pressed along the shaft axis by flange 4M which is fixed to shaft 4C by screws 4N, The purpose of this compression is to provide a tight seal between each ring 4B and corresponding cup seals 4A.

Flange plate 3F is fixed to sleeve 3 by screws and serves as the outer lateral closing of the whole concentric arrangement of central pipe, shaft rings, seals, bearing and sleeve.

The contact surface area 3D is part of the elements that influence the sealing force; thus, the pressure of the flowing fluid, the nature of the material and contact surface and the actual size and shape of seal packing define the sealing force, and in the context of our preferred embodiment, such sealing mechanism can cope with the possible pressure differential generated between adjacent circumferential conduits in order to keep separate the individual fluid flow conditions and control. Regarding the fluid flow separation in individual circumferential conduits 3B, thin flow paths 3I are provided across the sleeve 3 wall, each one located between adjacent seals 4A so as to relieve any leakage from the circumferential conduits and therefore prevent any fluid flow from one circumferential conduit to another; flow paths 3I might also be used for detecting leakage if a proper instrument is provided.

Figure 4A:
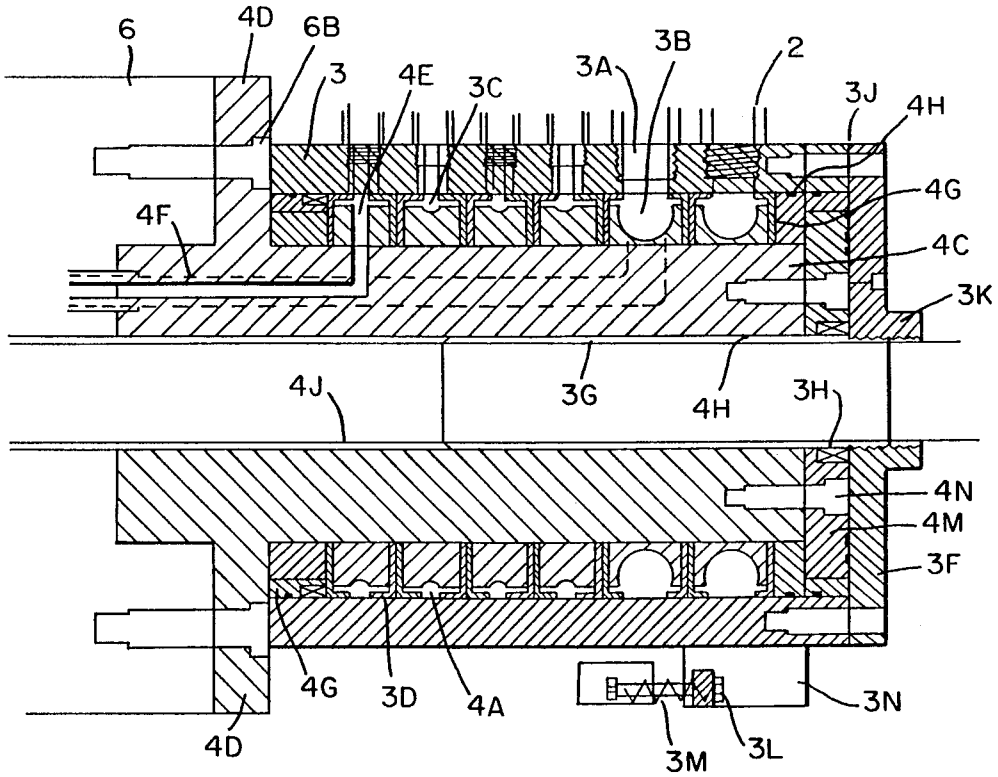
Figure 4B:
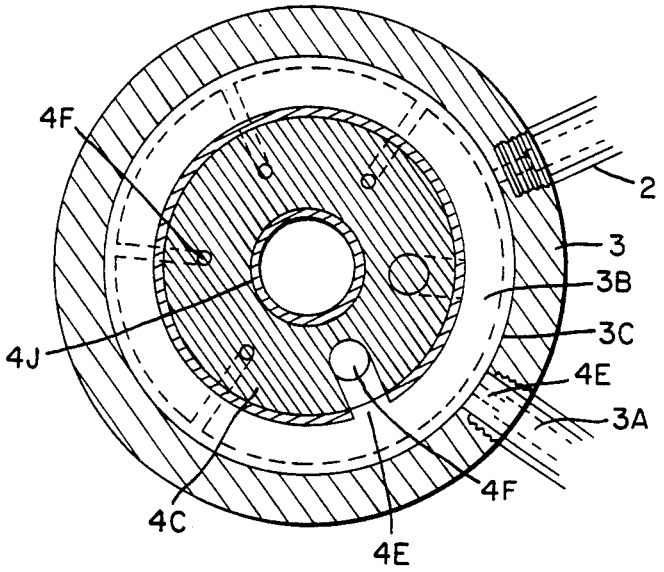

Sizing of conduits 3B and passageways 4F in shaft 4C may be dimensioned in accordance to the mass flow to be transported through the individual flow paths as in the example of the embodiment shown in FIGS. 4A and 4B.

In relation to the solid fines supply, fixed pipe 3E (FIG. 3) connects with a threaded hole 3K in sleeve flange 3F, and as a continuation of pipe 3E, stationary pipe 3G enters the rotary central shaft bore 4H, so that in rotation, shaft 4C moves respect to the pipe 3G. Shaft bore inner cylindrical wall 4H slides on and around the outer cylindrical surface of pipe 3G, and to provide sealing between these two static and rotating components, a proper set of seals 3H are provided.

Entry port 3J (see FIG. 4A) in sleeve 3 serves to introduce lubricant to the system. Continuing from static pipe 3G (FIG. 3), a rotating pipe 4J integrated to shaft 4 continues the adequately designed flow path for the solid fines stream; at this stage, the stream of solid is already in the rotating system. In changing from the static to the rotating system the flow path configuration for solid transport does not change its size and configuration.

Figure 2A:
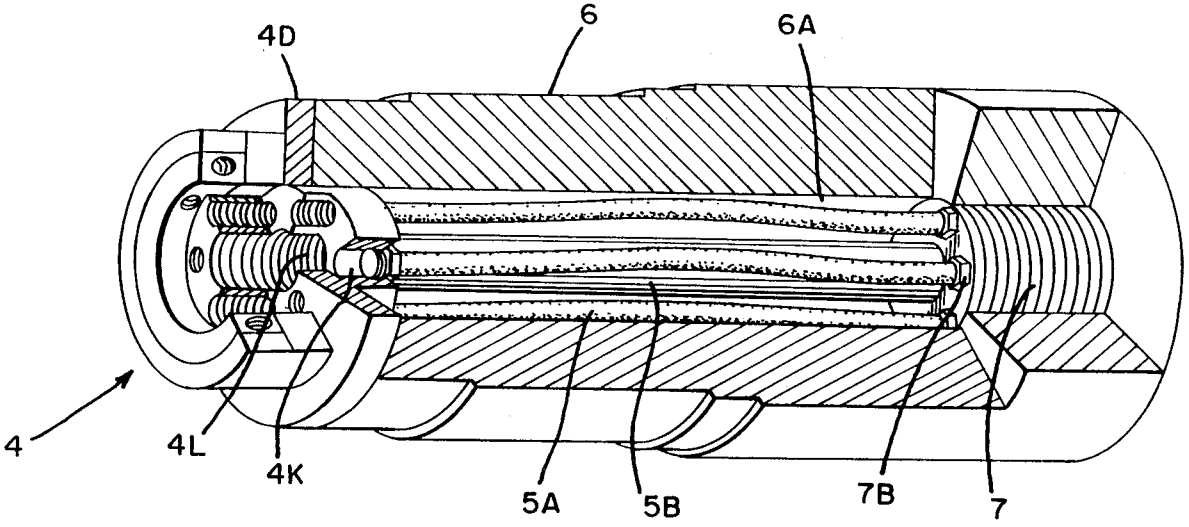

Gas passageways 4F and central pipe 4J in the rotary shaft 4C end up in shaft exit ports 4K and 4L, respectively. As shown in FIG. 2A, pipes 5A connect exit ports 4K to corresponding multi-passageway elbow entry ports 7A. Pipe 5B is joined to shaft exit port 4L at one extreme end and connected to threaded hole entry port 7B at the other extreme end. Pipe 5B is metallic and rigid, with the typical characteristics in configuration and properties for withstanding powder transport through it. Pipes 5A are preferably flexible for ease of assembly. This is because pipe 5B is first joined and the space left to connect pipes 5A is adequate only for non-rigid ones.

Thus in fixing pipes 5A and 5B at both ends, the whole arrangement is rigid and ready to be introduced through the central trunnion pin bore. Since elbow 7, and pipes 5A and 5B are introduced into trunnion pin central bore 6A (see FIG. 2A), shaft flange 4D is fixed to trunnion pin 6. After the shaft 4C is affixed to trunnion pin 6 (see FIG. 3), bearing 4G, piston ring type seals 4I, packing cup seals 4A and channeled rings 4B are mounted enveloping shaft 4C and packed by pressing flange 4M screwed to shaft 4C.

Sleeve 3 is mounted enveloping the previously mentioned rotable arrangement; ports 3A are adjusted in order to provide access for each one to its corresponding circumferential conduits 3B. Sleeve 3 is fixed to an external support 3N (see FIG. 4A) that serves to avoid rotation and to adjust the axial position of the sleeve. Said adjustment is provided by screws 3L and compressing springs 3M in a way that the contact force between flange plate 3F and pressing flange 4M can be adjusted by screws 3L.

According to FIG. 2, elbow 7 is set up in a way to avoid rotation with respect to trunnion pin 6, i.e., the elbow will always rotate with the trunnion pin; for this, the elbow is provided with wedge entries in order to permit the entry of a wedge from the pin central bore 6A. Once the elbow is positioned, a plurality of radially oriented pipes 10 are connected to threaded holes at exit ports 9. Pipes 10 connect side elbow exit ports 9 to the bottom tuyeres 11. A lateral opening 6C in trunnion pin 6 must be provided so as to be able to connect pipes 10 to ports 9 through opening 6C.

Figure 5:
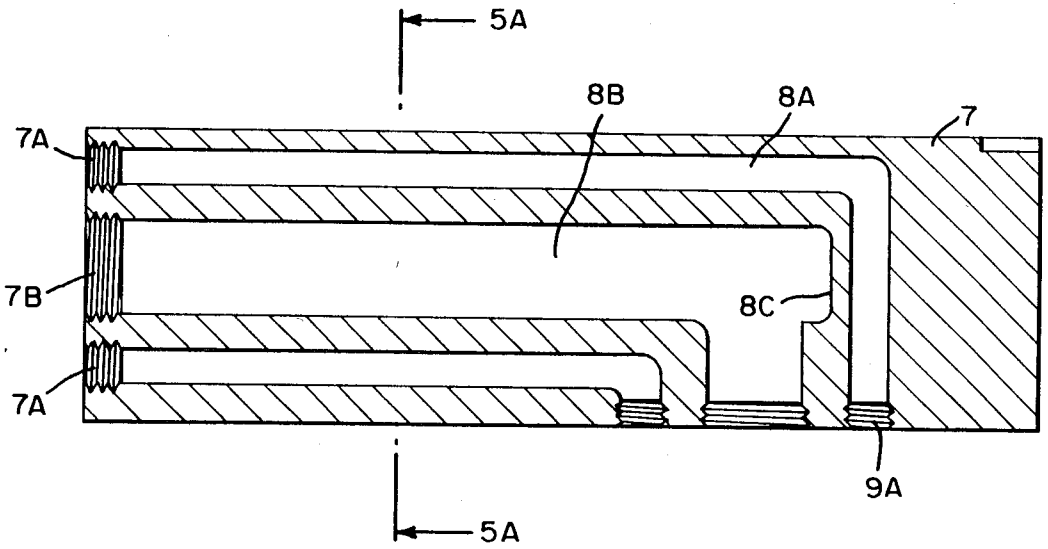
FIGS. 5, 5A, and 5B show longitudinal and perpendicular sectional views of the multi passageway elbow.
Figure 5A:
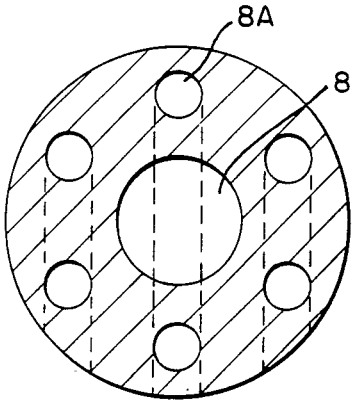
Figure 5B:
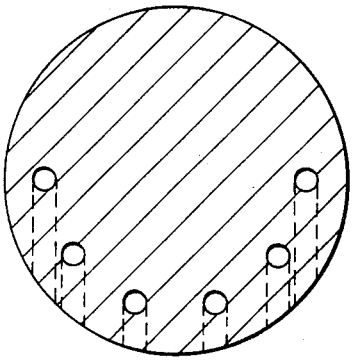
Figure 6:
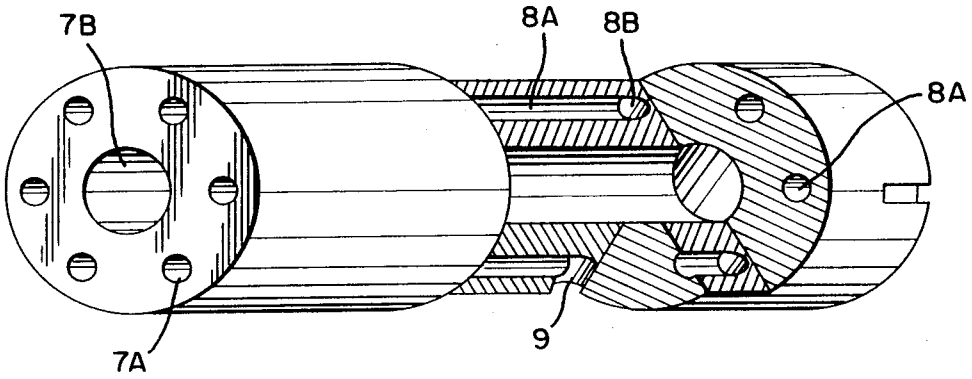
FIG. 6 shows various segments broken away of the elbow showing details of flow path deflection, entry ports and passageway relative diameters.

Elbow cylinder 7 may be configured as shown in FIG. 5 and FIG. 6 in which passages 8A are prepared for gas flow whereas passage 8B is prepared for solids transport as pointed out for our preferred embodiment; FIG. 5A shows a cross sectional view of this condiuit pattern. FIG. 5B shows a cross sectional view of another flow path pattern which is used for leading only gases and is applicable for example to the stirring gas bottom injection process for which each shaft passageway leads an individual gas up the bottom tuyeres.

Figure 7:
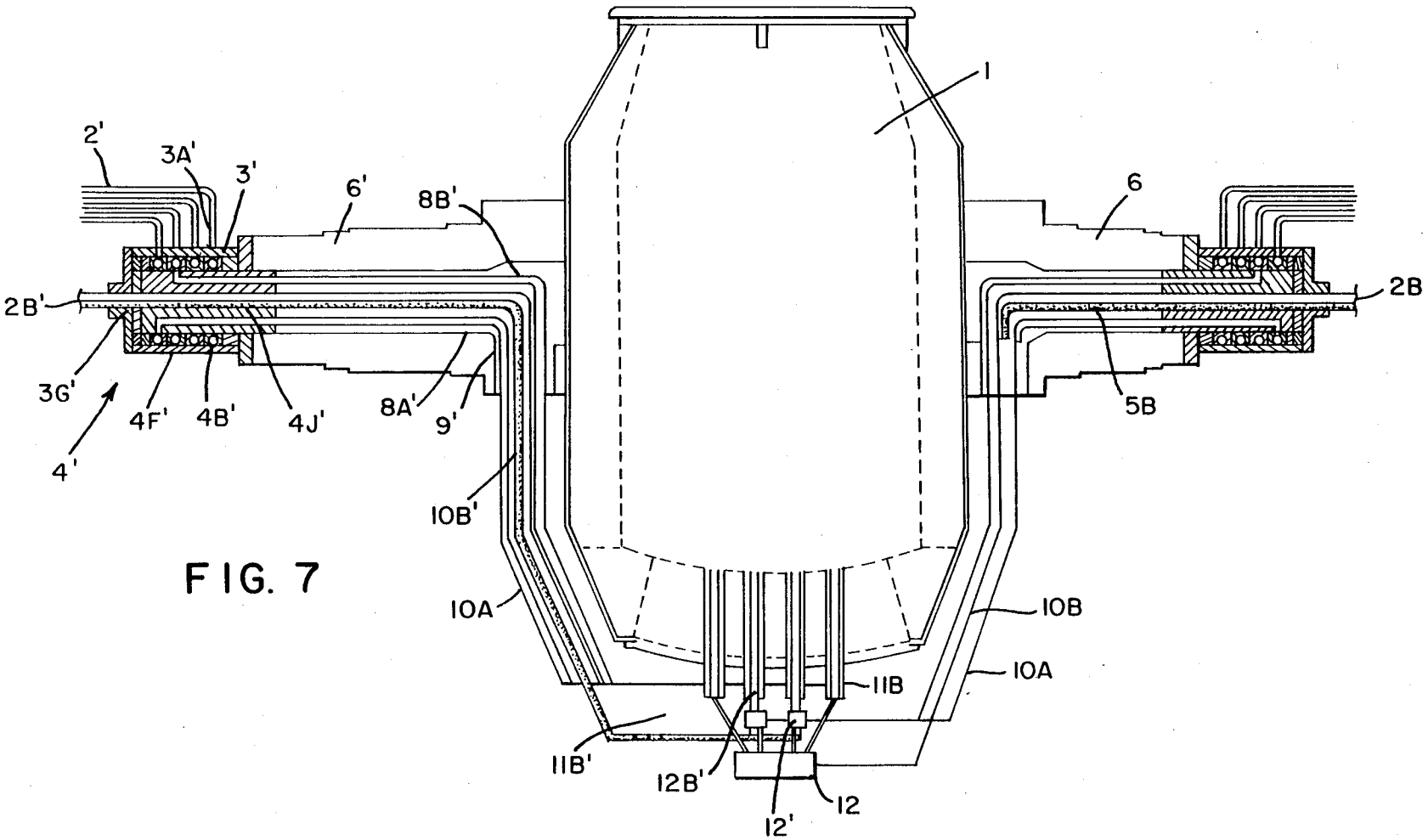
FIG. 7 shows an example of an embodiment with the application of two rotary joints in one converter for metal treatment.

Due to the way in which the mounting and assembly of the whole arrangement are designed, it is clear that this method and associated devices for introducing and transporting fluids and solids in a metallurgical converter can be implemented in an existing conventional converter of the BOF process type. An example of a full utilization of the method and devices presented in this invention is displayed in FIG. 7, which shows two trunnion pins equipped to supply at least five different gases and two different solid fines to several bottom tuyeres in a metallurgical converter. For this, two arrangements are provided, one for each trunnion pin 6 and 6'. Trunnion pin 6 is for instance prepared for introducing to the metal bath: oxygen, oxygen/lime mixture, argon, nitrogen and air, according to the stage of the process; while trunnion pin 6' is prepared for introducing propane, nitrogen/carbon bearing powder mixture, nitrogen, argon and carbon dioxide.

During a certain period of the process, oxygen is injected into the metal bath through a first and a second group of bottom nozzles. For the first group of nozzles oxygen is introduced conveying lime powder through the flow path consisting of: entry pipe 4F continued by inner shaft static pipe 3G and inner shaft rotating pipe 4J, then connecting the elbow central pipe 8B by conduit 58 and deflecting the oxygen/powder stream in point 8C to radial flow through pipe 10B to end up in bottom powder distributor 12, allotting the oxygen/powder mixture to each one of the central nozzles 11B of a first group of tuyeres.

The second group of central nozzles is supplied only with oxygen introduced to the system through a set of stationary conduits 2 connected to entry sleeve ports 3A to continue the fluid flow through circumferential conduit 3B, revolving pipes 4F, flexible pipe 5A and elbow conduits 8A; from elbow ports 9A oxygen is led to the second group of nozzles through pipes 10A.

During the same period of oxygen injection through a first and second group of central nozzles, annular nozzles 12B' (see FIG. 7) formed by a second pipe enveloping said central nozzles are supplying a cooling gas, for instance hydrocarbon. This gas is introduced to the converter through rotary joint 4' in a way that the gas for each bottom annular nozzle is supplied through independent flow paths and associated to each one there is an entry port 3A'. So each flow line follows a path similar to the ones described for the oxygen supply to the second group of nozzles: entry ports 3A', conduits 3B', revolving passageways 4F', pipes 5A, elbow conduits 8A' and pipes 10A to lead the separated hydrocarbon gas lines to each annular nozzle of the bottom tuyeres 11. In the mentioned portion of the process, the first group of bottom central nozzles injects oxygen/lime for metallurgical refining reasons and to balance the basicity ratio of the slag. During a following stage of the process in this instance, due to heat balance requirements to favor the melting of an increased amount of cold charge in the converter, a carbon bearing powder is injected. This is accomplished for instance using the second group of central nozzles by interrupting the oxygen flow and supplying nitrogen from the central pipe 2B', which as an immediate following step supplies carbon bearing powder through the central pipes: 3G', 4J', 5B', 8B', 10B' and finally to the mentioned second group of nozzles. A switching device in the bottom mechanism 12' is used to change the oxygen flow to nitrogen-nitrogen/carbon flow.

Another example of utilization of the present invention device and flow paths can be referred to a steelmaking process in which an inert gas is injected through the converter bottom in order to stir the bath during the process of oxygen injection into the metal bath by means of a top blown lance, through which the total of the oxygen is injected.

The liquid metal agitation producted by the inert gas injected through the bottom nozzles or injecting elements resullts in a significant improvement of final steel quality.

In this case the individual enntry ports 2 and individual lines thereof serve to introduce the transport the separated flow of inert gas up to the individual bottom tuyeres; central entry port 2B and a corresponding individual line can be used for common supplying to all bottom tuyeres of an alternative gas with no requirements of individual control by means of an adequate bottom distribution system not included in this invention.

From the description made of the improvements and attributes of the present invention, what we claim is:

1. A rotary joint apparatus for conveying fluid and powdered materials to a rotatable metallurgical converter from stationary sources, said apparatus comprising;

(a) outer stationary sleeve means having an axis and including a plurality of conduits extending substantially radially from the sleeve means relative to the axis and communicating with a source of flowable material and with an interior portion of the sleeve means through substantially radial ports in the sleeve means;

(b) inner rotatable sleeve means having an axis coaxial with the stationary sleeve means and rotatably carried within the stationary sleeve means, the rotatable sleeve means including a plurality of substantially radially extending ports communicating with respective axially extending passageways that terminate in respective outlets;

(c) rotatable trunnion means connected with the rotatable sleeves means for rotation therewith, the trunnion means having a plurality of internal axial openings communicating with respective ones of the axially extending passageway outlets of the rotatable sleeve means and with substantially radially extending conduits for connection with tuyeres carried by a rotatable metallurgical vessel carried by the trunnion means and communicating with the interior of the vessel; and (d) a plurality of stationary annular chambers positioned in axially spaced relationship between the outer stationary sleeve means and the inner rotatable sleeve means, each annular chamber communicating with a source of flowable material through the substantially radial ports in the outer sleeve means and communicating with a respective one of the passageways in the rotatable sleeve means through a respective substantially radial port in the inner rotatable sleeve means.

2. A rotary joint apparatus in accordance with claim 1, wherein the annular chambers are coaxially positioned and are adjacent to each other, and the chambers have substantially equal inner diameters and substantially equal outer diameters.

3. A rotary joint apparatus in accordance with claim 1, wherein the annular chambers are defined by a plurality of annular channel rings disposed in side-by-side relationship to define a sleeve-like structure positioned between and contacting respective surfaces of each of the stationary and rotatable sleeve means.

4. A rotary joint apparatus in accordance with claim 3, including sealing means positioned between adjacent channel rings to prevent leakage of flowable material from one channel ring to an adjacent channel ring.

5. A rotary joint apparatus in accordance with claim 1, including a plurality of flexible conduit means extending between respective ones of the rotatable sleeve means outlets and the rotatable trunnion means axial openings.

* * * * *